US006158145A

United States Patent [19]

Landon et al.

[11] Patent Number: 6,158,145

[45] Date of Patent: Dec. 12, 2000

[54] METHOD FOR A HIGH TURBULENCE CYCLONIC DRYER

[76] Inventors: Frank D. Landon, 1822 E. Camino Ave., Santa Ana, Calif. 92705; H. Tom. Sawyer, 1760 Azusa San Gabriel Canyon Rd., Azusa, Calif. 91706

[21] Appl. No.: 09/032,088

[22] Filed: Feb. 27, 1998

[51] Int. Cl.[7] ..... F26B 3/08

[52] U.S. Cl. ..... 34/364; 34/369; 34/371

[58] Field of Search ..... 34/364, 369, 371, 34/487, 576, 583, 588, 594, 168, 182, 183, 231, 233; 110/224

[56] References Cited

U.S. PATENT DOCUMENTS

| | | | |
|---|---|---|---|
| 3,632,257 | 1/1972 | Ashizawa | 425/222 |
| 3,766,661 | 10/1973 | Bayens et al. | 34/371 |
| 4,057,908 | 11/1977 | Mirliss et al. | 34/360 |
| 4,101,263 | 7/1978 | Lumpkin, Jr. | 432/13 |
| 4,454,661 | 6/1984 | Klein et al. | 34/594 |
| 5,791,066 | 8/1998 | Crews | 34/168 |

*Primary Examiner*—Pamela A. Wilson

*Attorney, Agent, or Firm*—Fish & Associates, LLP; Robert D. Fish

[57] ABSTRACT

A method is provided in which particulate matter is dried in a high velocity cyclonic dryer having inner and/or outer ring deflectors. Contemplated initial air stream velocities are at least about 100 feet per second, with more preferred velocities at least 300 feet per second, and still more preferred embodiments at least 500 feet per second. In one aspect of preferred embodiments the combination of high velocity air flow and ring deflectors advantageously provides significant drying of the particulate matter using both relatively low temperatures and relatively short transit times. Contemplated temperatures of the air stream entering the dryer are between about 50° F. and about 300° F., with more preferred temperatures between about 60° F. and about 150° F., and still more preferred temperatures between about 70° F. and about 120° F. Contemplated transit times are from less than 2 seconds to more than 10 seconds, with preferred transit times falling between about 2 seconds and about 7 seconds, and with still more preferred transit times falling between about 2 and about 5 seconds. In another aspect of preferred embodiments, the material being dried is fibrous, and the material experiences significant fluffing during the drying process.

23 Claims, 7 Drawing Sheets

METHOD FOR A HIGH TURBULENCE CYCLONIC DRYER

FIELD OF THE INVENTION

The field of the invention is cyclonic dryers.

BACKGROUND OF THE INVENTION

There are many applications requiring drying of particulate matter. For example, grains and powdered foodstuffs may be dried to prevent decomposition and prolong shelf life, solvent treated pharmaceuticals and other compositions may be dried to remove and/or recover a solvent, and pulped or other processed wastes may be dried to reduce the weight, volume, and objectionable nature of the components to facilitate recovery or disposal.

There are many known methods of drying particulates, including tumble drying, centrifugal drying, flash drying, cyclonic drying, microwave and radiative heat drying. Most of these methods involve some sort of agitation of the material to be dried, along with application of heat. Preferred methods of drying a particular material depend upon many factors, including the wetness of the material to be dried, the tenacity with which the material holds onto the wetting agent, the degree of dryness required, fragility of the material to agitation or heat, the expected disposition of the material when dried, and special difficulties encountered during drying.

Some particulate matter is especially difficult to dry because it tends to aggregate together into masses, cakes and other types of clumps. Such clumps tend to be resistant to drying due to relatively low surface to volume ratios. Increasing the agitation applied to the clumps is not necessarily desirable, as it often merely increases the tendency of such clumps to stick to the inner surfaces of the drying vessel being used. Increasing the applied heat is also not necessarily advantageous, and may lead to incineration or other destruction of the material being dried.

Waste paper pulp provides a good example of these phenomena. Waste paper pulp is generally dried for periods of tens of minutes at 250° F. to 350° F., in a tumble dryer. Attempts at drying paper pulp using rapid movement or compression of the pulp only leads to further aggregation of the material, which in turn causes even greater difficulties. Increasing the applied heat is helpful up to a point, but eventually leads to burning of the pulp fiber ends. In addition to all of these other difficulties, known methods for drying waste pulp generally result in relatively large clumps, averaging several millimeters across. Such clumps have little or no commercial value for making paper because of their low degree of fluffiness, and are usually discarded. Fluff generators are known, but add additional expense and still do not necessarily provide adequate results due to fiber damage. Other particulate materials besides waste paper pulp have similar difficulties, including various natural and artificial fibers wool, cotton, and polyester.

There are a few technologies which provide a very high degree of agitation at a relatively low temperature. U.S. Pat. No. 5,548,905 to Kuma et al. (August 1996), describes a rapid dehydrating and drying method in which a high speed, low temperature air stream (approximately 60° C.) is applied against sheet-like articles such as mats, carpets, and fabrics. In that patent the drying is effected by a strong negative pressure air stream used alone or in combination with a strong positive pressure air stream. The Kuma et al. method, however, is not suitable for particulate matter because there is no provision for immobilizing the particles against the high speed air stream. U.S. Pat. No. 4,695,248 to Gray et al., describes a method of drying particulate matter using very high turbulence provided by the exhaust of a pulse jet engine. In that patent a typical temperature is recited at 2500° F., although a very short residence time on the order of milliseconds of the material being dried is reported to result in dried solids at about 100° F. to 150° F. The Gray method is, however, is problematic in that it damages the ends of fibers, is relatively expensive to implement, and may be impractical in many circumstances.

Drying of particulates in cyclonic dryers is known to have several advantages, including cost effectiveness and applicability to many different materials. Cyclonic dryers, however, are not generally known to be suitable for materials which tend to aggregate into clumps when damp. U.S. Pat. No. 4,057,908 to Mirliss et al. (November 1977), for example, describes the use of a cyclonic dryer for drying damp powders, but the cyclonic dryer is used in combination with a pre-dryer where the damp material is suspended on a column of low velocity heated gas until it is sufficiently dried to enter the cyclonic portion of the dryer.

In FIG. 1 a typical prior art cyclone dryer 10 generally has an upper section 20, a middle section 30, a lower section 40, an inlet 50, an upper outlet 60 and a lower outlet 70. The cyclone dryer 10 is largely hollow, with the upper, middle and lower sections 20, 30, 40 cooperating to provide a substantially continuous cavity 80. Cyclone dryer 10 is operated by introducing an air stream depicted by arrow 90 into the inlet section 40, and directing the air stream 90 along the periphery of the cavity 80. The air stream 90 generally flows in a downward spiral, substantially tangential to the longitudinal axis of the cavity 80, and exits the dryer 10 at lower outlet 70. Such motion produces un upward flowing vortex 96, which exits the dryer 10 at upper outlet 60. When conditions are appropriate, a material to be dried is introduced into the dryer along with air stream 90, carried along the downward spiral 96, back up in vortex 96, and finally carrier out of the dryer at upper outlet 60.

Typical transit time of particulates in a cyclone dryer such as that depicted in FIG. 1 is about 3 to 5 seconds. Transit time is known to be affected by several variables, including the dimensions of the cavity, velocity of the air stream within the cavity, and density and other flight characteristics of the damp material. Drying is of the material is also known to be affected by several variables, including the amount of moisture or other solvent in the material, the surface area and other characteristics of the material, the transit time of the material in the dryer, and the temperature and moisture carrying capacity of the air stream. Cyclonic dryers are typically operated using an inlet air stream velocity of between 25 and 100 feet per second, and an inlet air stream temperature of between 100° F. and 500° F. These and other details are described in standard reference works, including the *Handbook of Industrial Drying*. ($2^{nd}$ Ed., Arun S. Mujumder, editor, 1995).

Materials such as waste paper pulp carrying more than about 60% weight of water or other solvent cannot effectively be dried in a prior art cyclone dryer such as that shown in FIG. 1. Years of experimentation have demonstrated that this is true regardless of variations in the size and shape of the various sections, and the velocity and temperature of the air stream. The main problem is that relatively low velocity air streams (25 and 100 eet per second) are insufficiently turbulent and provide insufficient transit time to dry the damp material, while relatively high velocity air streams (100 and 500 feet per second) impart such centrifugal force to the material that it tends to the side walls of the dryer. This dichotomy has been partially addressed in the art. U.S. Pat. No. 4,089,119 to Heinze (May 1978) and U.S. Pat. No. 5,333,392 to Heinze (August 1994) describe dryers containing annular baffles which alter the air stream such that a high velocity (20 m/sec to 100 m/sec) and short residence time (on the order of a few seconds) prevail in the lower part of the dryer, and a low velocity and high residence time prevail in the upper part of the dryer. Additionally, U.S. Pat. No. 5,647,142 to Anderson (July 1997) describes the inclusion of perforated plates to increase transit times. Even these solutions, however, are only partially satisfactory because they still require the air stream to be heated to effect substantial drying.

Thus, there is a continued need for methods and apparatus which provide low temperature drying of particulates, especially particulates which have a tendency to aggregate into a mass when damp.

SUMMARY OF THE INVENTION

The present invention is directed to methods, apparatus and products in which particulate matter is dried in a high velocity cyclonic dryer having inner and/or outer ring deflectors. Contemplated initial air stream velocities are at least about 100 feet per second, with more preferred velocities at least 300 feet per second, and still more preferred embodiments at least 500 feet per second.

In one aspect of preferred embodiments the combination of high velocity air flow and ring deflectors advantageously provides significant drying of the particulate matter using both relatively low temperatures and relatively short transit times. Contemplated temperatures of the air stream entering the dryer are between about 50° F. and about 300° F., with more preferred temperatures between about 60° F. and about 150° F., and still more preferred temperatures between about 70° F. and about 120° F. Contemplated transit times are from less than 2 seconds to more than 10 seconds, with preferred transit times falling between about 2 seconds and about 7 seconds, and with still more preferred transit times falling between about 2 and about 5 seconds.

In another aspect of preferred embodiments, the material being dried is fibrous, and the material experiences significant fluffing during the drying process.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
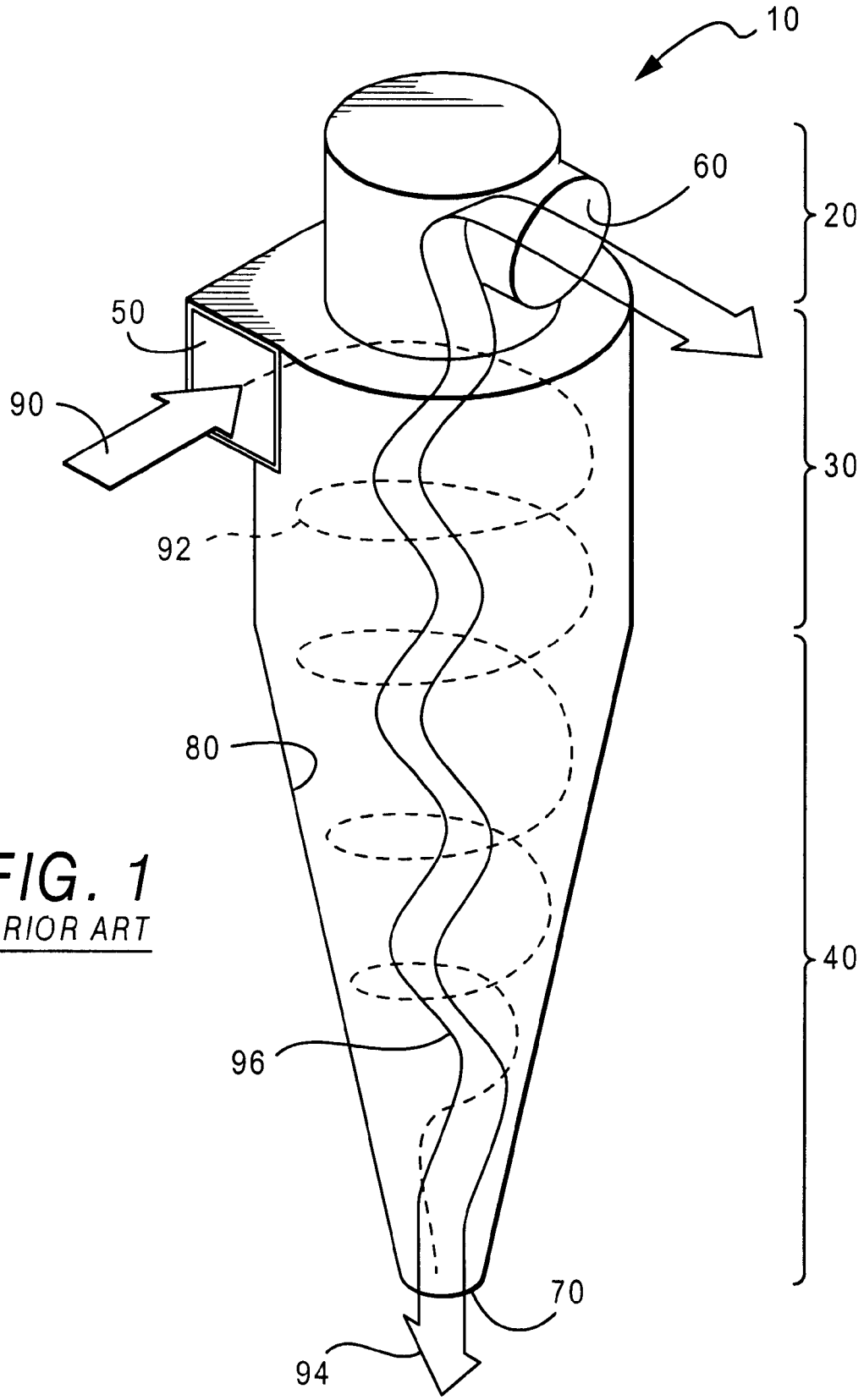
FIG. 1 PRIOR ART
FIG. 1 is a perspective view of a prior art cyclone dryer, illustrating a flow of particulates through the cyclone.
Figure 2:
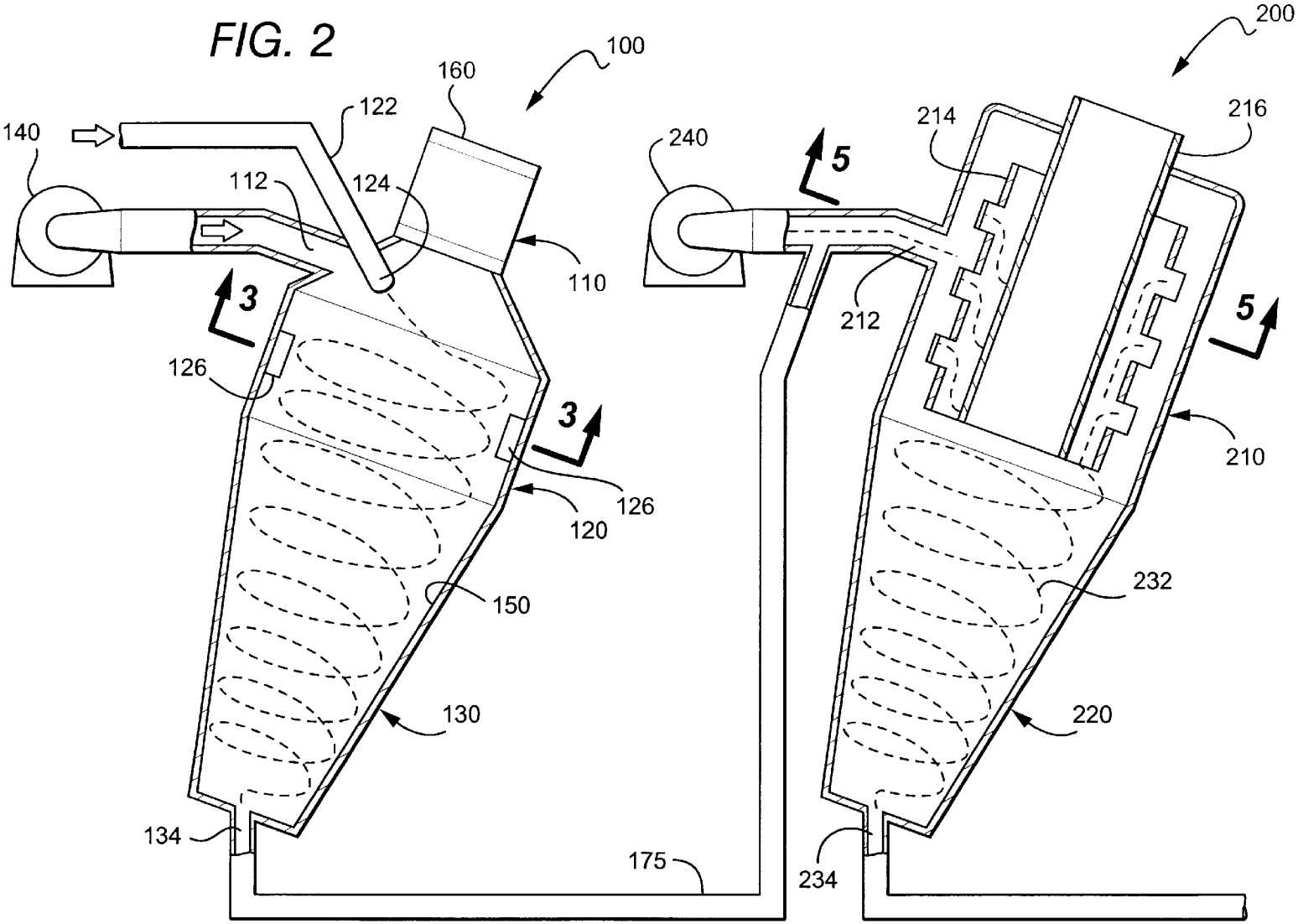
FIG. 2 is a side view of a preferred cyclone dryer system according to an embodiment of the present invention.

Turning to FIG. 2, an improved cyclone drying system 99 generally includes two dryers, a pre-dryer 100 and a main dryer 200, each of which can be used independently of the other in alternative embodiments.

Pre-dryer 100 is generally tilted off vertical as shown in the drawing, and includes a upper section 110, a middle section 120 and a lower section 130 which collectively define a substantially continuous inner cavity 150. A high velocity air stream is preferably created by a compressor 140, and enters the pre-dryer 100 tangentially in the top section 110 at air inlet 112. In general, the high velocity air stream follows a roughly cyclonic or vertical path, spiraling downward on along the periphery of inner cavity 150, and then spiraling upward as exhaust towards the center of inner cavity 150. Most of the exhaust exits the pre-dryer 100 via exhaust port 160, which exit may be aided by use of an exit fan (not shown) housed in the upper section 110.

A materials input pipe 122 directs material to be dried enters the pre-dryer 100 along a path separate from the air stream, and terminates at an outlet orifice which is preferably positioned just below the boundary between the top section 110 and the middle section 120. Adjacent the outlet orifice of the input pipe 122 is a foot 124, which itself is advantageously positioned such that the pressure within input pipe 122 is either below or just above atmospheric pressure. This allows material to be fed into pre-dryer 100 at relatively low pressure, and possibly using only a gravity feed.

After leaving pipe 122, the material being dried picks up speed and begins to swirl about inner cavity 150. Fast moving material takes up a ring type configuration in middle section 120, with the outer portion of the ring being bounded by the inner side walls of middle section 120, and the inner portion of the ring bounded by the upwardly spiraling exhaust. In previous cyclonic dryers the centrifugal force would be sufficient in many instances to plaster relatively wet material against the side walls, which would accumulate until the dryer was thoroughly clogged. Here, however, the presence of outer ring deflectors 126 introduce eddies and other considerable turbulence in the path of the material which largely prevent wet material from sticking to the inner side walls of middle section 120. (see FIG. 3).

Eventually the material being dried spirals downward into bottom section 120, and finally leaving the pre-dryer 100 at materials outlet 134. Upon leaving materials outlet 134, the material is generally only partially dried, and is fed along line 175 to the main dryer 200. Along line partially dried material is added to a second high pressure air stream created by compressor 240, and enters the main dryer 200 through a non-tangential common air/materials inlet 212.

Main dryer 200 is generally also tilted off vertical as shown, and includes a top section 210 and a bottom section 220. Inside top section 210 is a collector 214 and a vortex director 216. Material entering main dryer 200 generally travels in a substantially circular path 232 between the inside wall of top section 210 and collector 214, until redirected by inner deflectors 218 through capture ports 219 of collector 214. Redirected material then spirals downward between collector 213 and vortex director 216, and then continues to spiral downward through bottom section 220, and finally leaves the main dryer through outlet 234.

As used herein, the term "ring deflectors" refers to radially positioned members which function to deflect a substantially ring-shaped flow of material away from a substantially circular path. In the case of outer ring deflectors, such as outer deflectors 126, the members are positioned along a wall of middle section 120, which defines the outermost possible circumference of the ring. In the case of inner ring deflectors, such as inner deflectors 218, the members are positioned along a wall of collector 214, which defines the innermost possible circumference of the ring. Although not shown, it is also contemplated to provide both inner and outer ring deflectors within the same housing.

Figure 3:
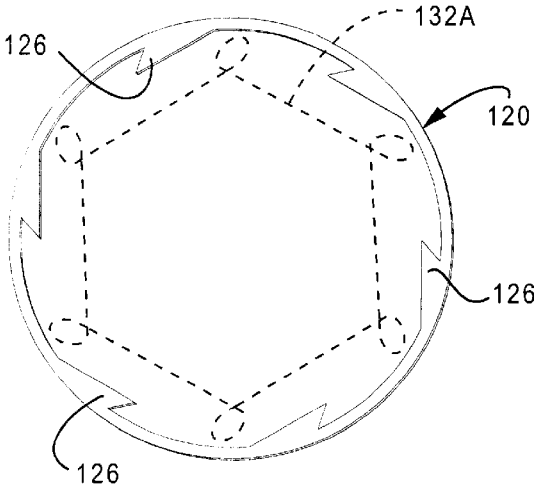
FIG. 3 is a cross-section of the pre-dryer of FIG. 1 taken at A—A.

Turning to FIG. 3, a plurality of inner ring deflectors 126 project inwardly from a wall of the middle section 120 of pre-drier 100. This causes an otherwise relatively smooth circular path to be disrupted by eddies, cross-flows and other manifestations of turbulence, as shown by path 132A. These outer ring deflectors 126 may be provided in many different sizes, shapes and orientations other than that shown, and to some extent variations need to be individually tested for effectiveness. Having spent considerable time on this problem, the present inventor has discovered that in a pre-dryer 100 having a middle section with an inner diameter of about 3 feet, preferred outer ring deflectors would extend inwards on the order of a few inches, and would have an overall length of about 6 inches.

Figure 4:
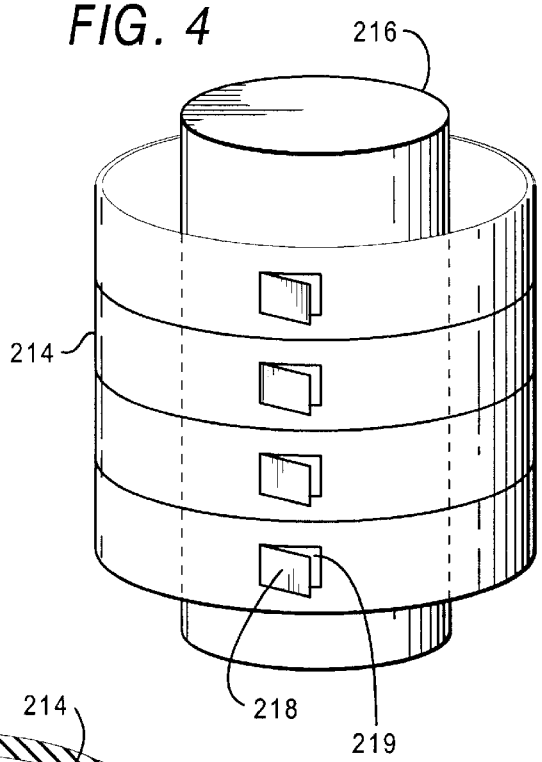
FIG. 4 is a perspective view of the collector and vortex director of the main-dryer of FIG. 1.
Figure 5:
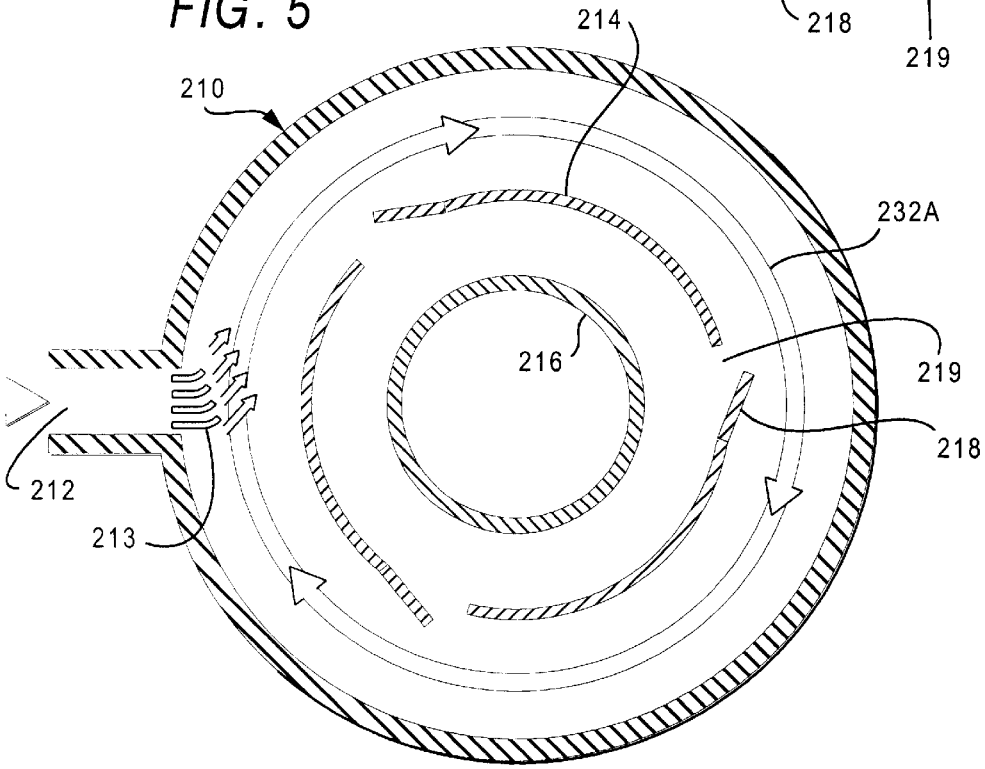
FIG. 5 is a cross-sectional view of main dryer of FIG. 2 taken at B—B.

FIGS. 4 and 5 depicts collector 214 and vortex director 216 in greater detail. In general, the air stream entering via inlet 212 along with the partially dried material entering concurrently with the air stream, are deflected by vanes 213. The air stream and material then take somewhat different paths. The air stream circulates relatively few times between collector 214 and top section 214, and is rapidly deflected by inner ring deflectors 218 through capture ports 219. The partially dried material, on the other hand, may circulate hundreds of times about the collector 214, building up into a relatively dense circulating "ring" 232A. The newer, wetter portion of the ring 232A tends to have a greater density, and is pushed radially to the outside by centrifugal force, while the older, dryer portion of the ring 232A tends to have a lesser density, and is pushed radially to the inside. Eventually, either the material dries sufficiently to either be deflected by the inner ring deflectors 218 through the capture ports 219, or pushed through the capture ports 219 by the addition of even wetter material through inlet 212. Material passing through capture ports 219 spirals downwards between collector 213 and vortex director 216, and then eventually spirals down through bottom section 220 and out exit 234. Thus, In this manner the material finally exiting the main dryer 200 can be made quite dry, and in any even the dryness can be controlled to a considerable extent by the rapidity with which new material is forced through the system.

Thus, the improved dryer system 99 differs substantially from prior art cyclonic dryers in that it uses a combination of high velocity air stream with ring deflectors. Experimentation has shown that the parameters employed with such systems are important, although operating ranges are relatively broad. For example, experimentation has shown that the initial air stream velocities entering the pre-dryer 100 and the main dryer 200 should each be at least about 100 feet per second, with more preferred velocities at least 300 feet per second, and still more preferred embodiments at least 500 feet per second. It has also been determined that the temperatures of the intake air streams entering the pre-dryer 100 and the main dryer 200 can fall between about 50° F. and about 300° F., with more preferred temperatures between about 60° F. and about 150° F., and still more preferred temperatures between about 70° F. and about 120° F. Thus, it is entirely possible to operate devices according to the present disclosure using non-heated air. Still further it has been experimentally determined that average transit times of material in each of pre-dryer 100 and main dryer 200 can successfully range from less than 2 seconds to more than 10 seconds, with preferred transit times falling between about 2 seconds and about 7 seconds, and with still more preferred transit times falling between about 2 and about 5 seconds.

Figure 6A:
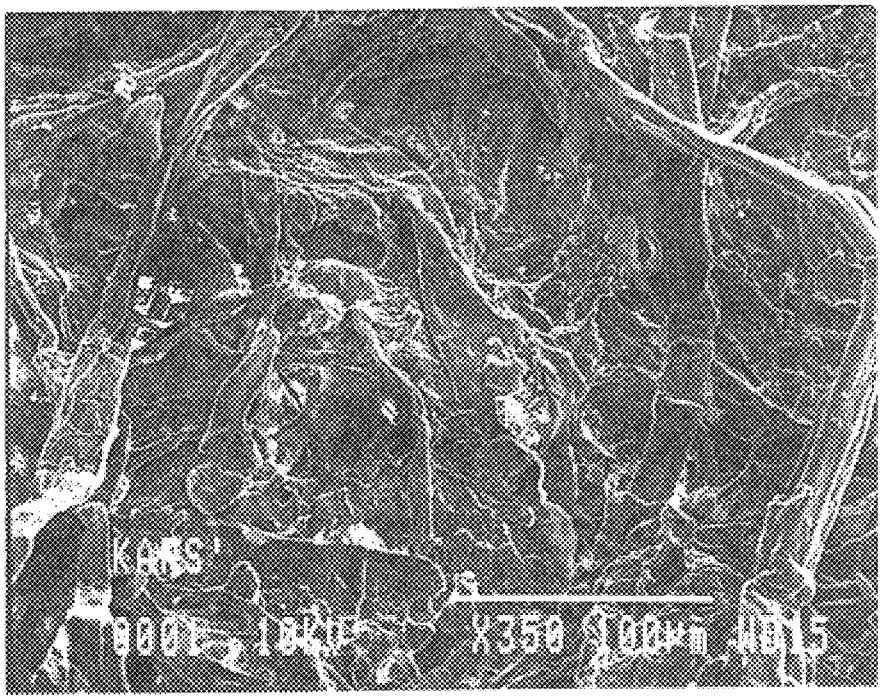
FIGS. 6A and 6B are photomicrographs of a damp fibrous waste at 350× and 1,800× magnification, respectively.
Figure 6B:
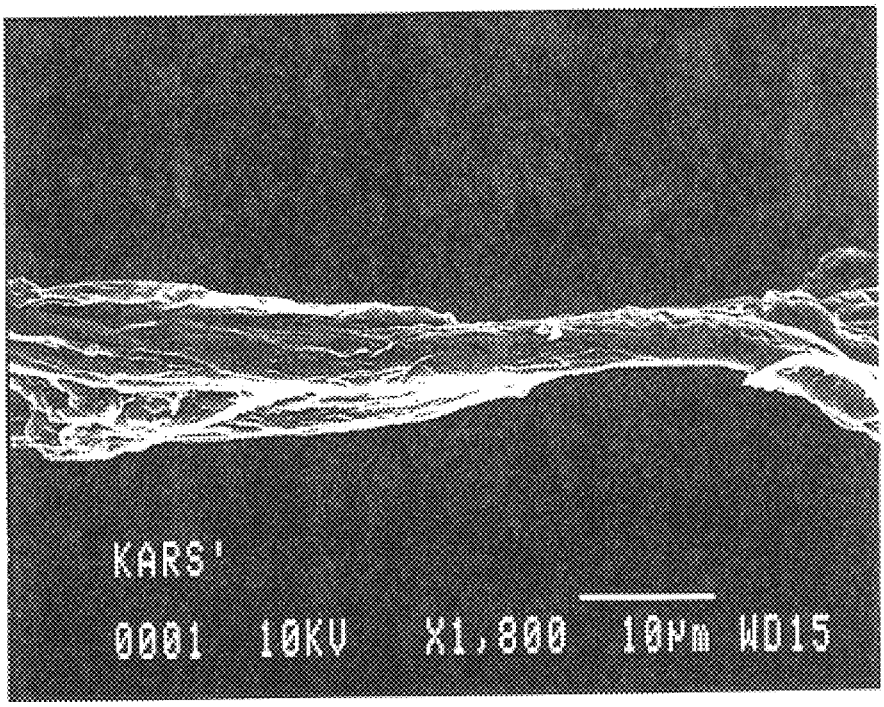
Figure 7A:
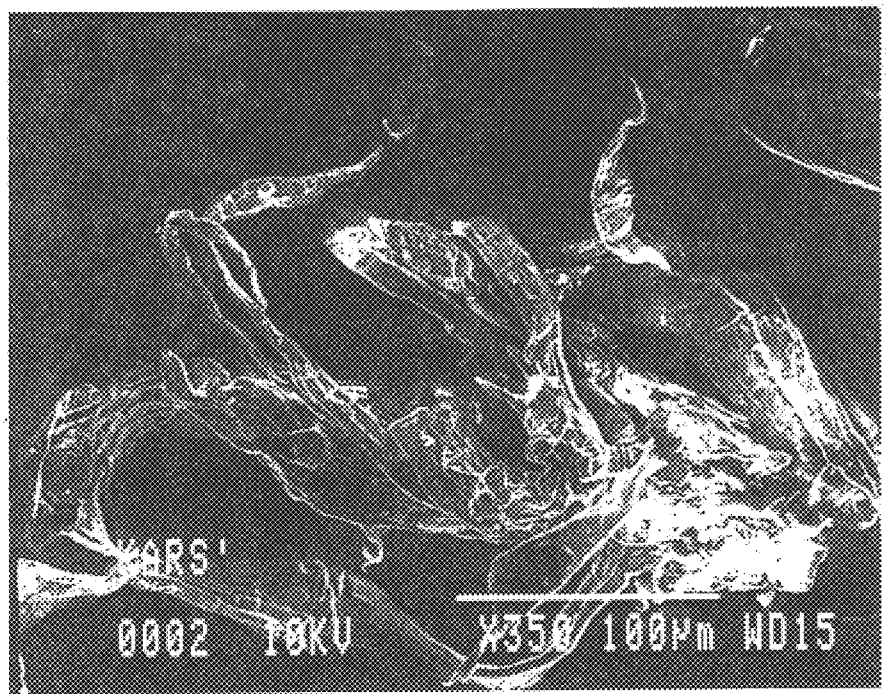
FIGS. 7A and 7B are photomicrographs at 350× and 1,800× magnification, respectively, of the waste of FIGS. 6A and 6B, dried in a tumble dryer.
Figure 7B:
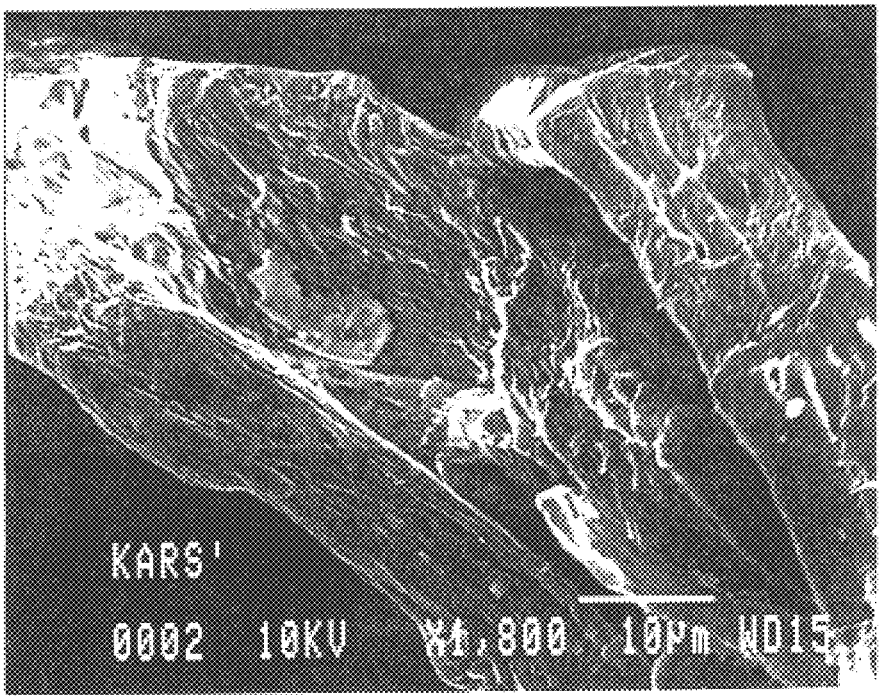

Experimentation has also demonstrated that new, highly fluffed products can produced according to the present disclosure. In one set of experiments, a wet, fibrous, paper pulp waste was generated at a paper plant. FIG. 6A is a photomicrograph of such waste at 350× magnification, and FIG. 6B is a photomicrograph of such waste at 1,800× magnification. In this form the waste has essentially no commercial value, and is often hauled away at a cost of about $50 per ton. Such waste is also extremely difficult to dry. There are no commercially successful attempts to dry such waste in a cyclone dryer due to the sticking problems discussed above, and even drying in a tumble dryer is of marginal utility. FIGS. 7A and 7B are photomicrographs at 350× and 1,800× of the waste of FIGS. 6A and 6B which has been dried in a tumble dryer for about 20 minutes, with circulating heated air at about 250° F. The dried waste still has about 30% moisture content by weight, and the strands are only about 50% larger than the undried waste. This material still has essentially no commercial use.

Figure 8A:
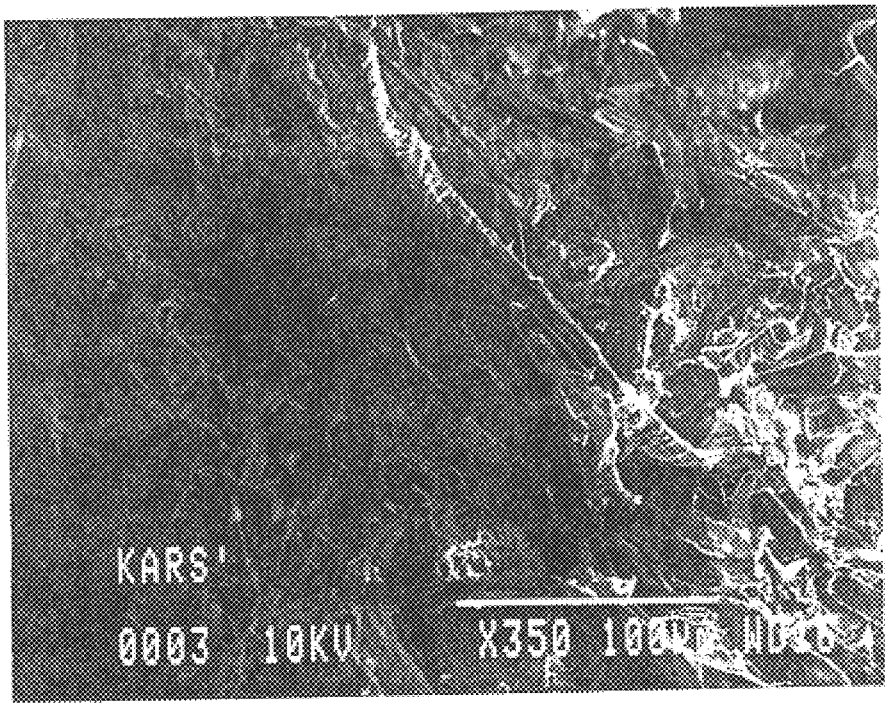
FIGS. 8A and 8B are photomicrographs at 350× and 1,800× magnification, respectively, of the waste of FIGS. 6A and 6B, dried according to an embodiment of the present invention.
Figure 8B:
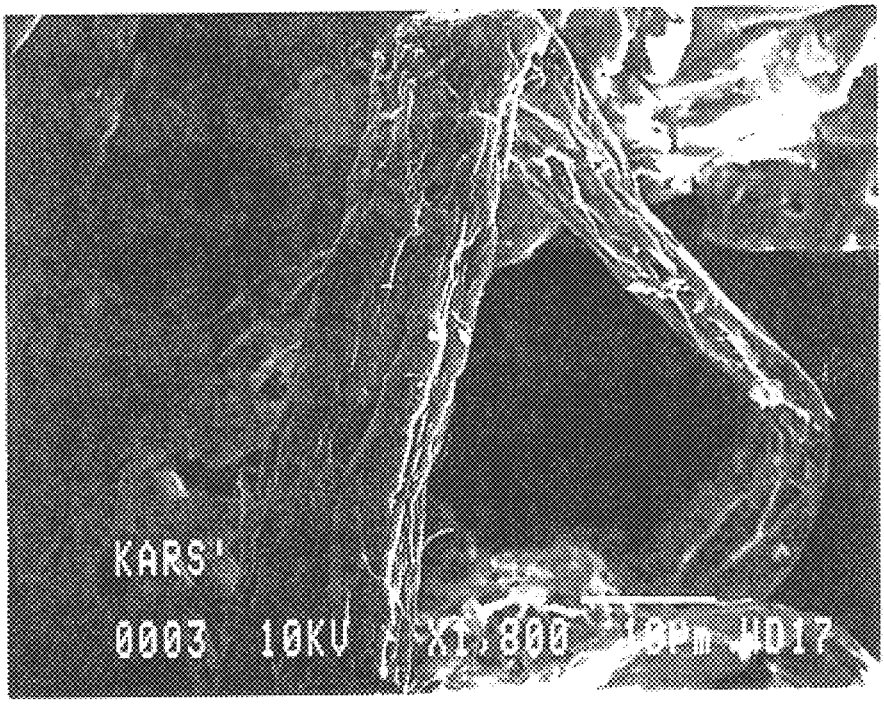

In contrast, FIGS. 8A and 8B are photomicrographs at 350× and 1,800× of the waste of FIGS. 6A and 6B which has been dried in a device substantially the same as that shown and described with respect to FIG. 2. In this case the air flow into the pre-dryer was about 400 feet per second, unheated atmospheric air at about 70° F. and the transit time of material was about 10 seconds. The air flow into the main dryer was about 400 feet per second, unheated atmospheric air at about 70° F. and the transit time of material was about 12 seconds. Once again, the material was dried to about 30% moisture content by weight. Significantly, however, the strands are about 30% larger than the undried waste, and the material has a visibly fluffy or shredded appearance. The product in this case is commercially valuable, and can be used along with other material in the making of paper and other product.

Figure 9A:
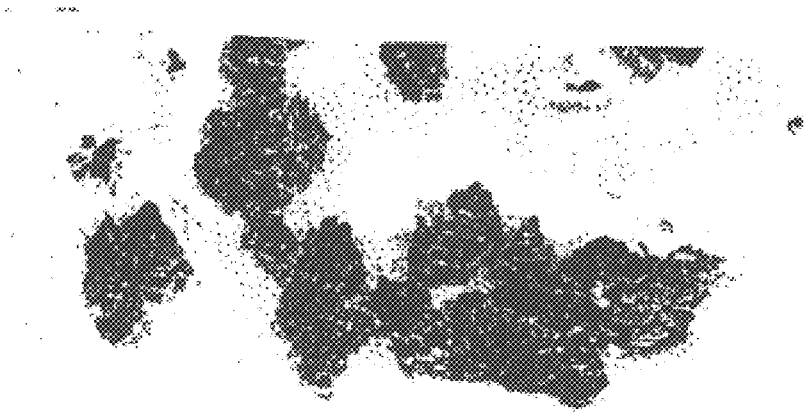
FIG. 9A is a photocopy of the material of FIGS. 6A and 6B.
Figure 9B:
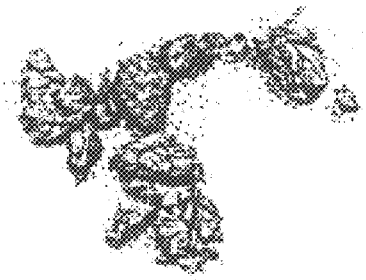
FIG. 9B is a photocopy of the material of FIGS. 7A and 7B.
Figure 9C:
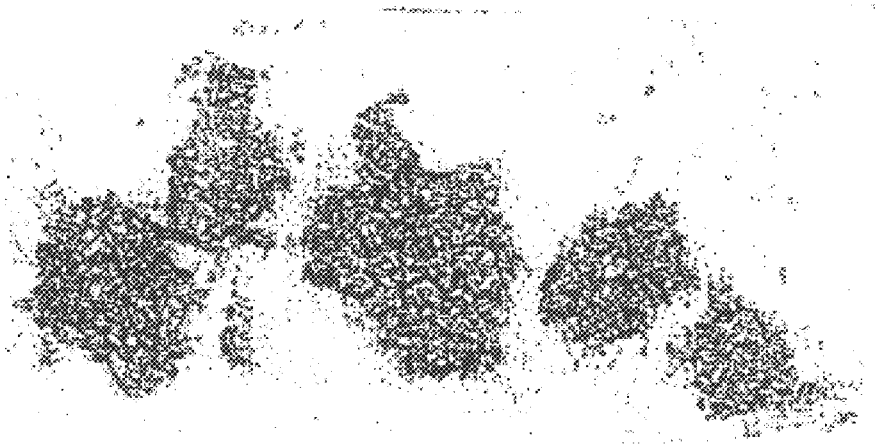
FIG. 9C is a photocopy of the material of FIGS. 8A and 8B.

These differences in product are apparent even in photocopies. FIG. 9A is a photocopy of the clumps of material in FIGS. 6A and 6B, FIG. 9B is a photocopy of the clumps of material FIGS. 7A and 7B, and FIG. 9C is a photocopy of the fluffy material in FIGS. 8A and 8B.

Thus, specific embodiments and applications of methods, apparatus and products have been disclosed, in which particulate matter is dried in a high velocity cyclonic dryer having inner and/or outer ring deflectors. It should be apparent, however, to those skilled in the art that many more modifications besides those already described are possible without departing from the inventive concepts herein. The inventive subject matter, therefore, is not to be restricted except in the spirit of the appended claims.

What is claimed is:

1. A method of drying a particulate material, comprising:

providing a high velocity air stream of at least 100 feet per second;

providing a first chamber which receives the high velocity air stream and thereby develops a vortex;

introducing the material into the first chamber;

entraining the material in the first chamber to travel for a period of time in a substantially ring shaped path;

deflecting the material traveling in the ring shaped path with at least one of an inner ring deflector and an outer ring deflector; and causing the material to exit the first chamber.

2. The method of claim 1 wherein the step of introducing the material into the first chamber comprises introducing the material into the first chamber under gravity feed.

3. The method of claim 2 wherein the step of deflecting the material comprises employing a plurality of outer ring deflectors.

4. The method of claim 2 wherein the step of deflecting the material in the first chamber comprises employing a plurality of outer ring deflectors, and further comprising deflecting the partially dried material in the second chamber using a plurality of inner ring deflectors.

5. The method of claim 1 wherein the step of introducing the material into the first chamber comprises introducing the material into the first chamber using a common air stream/materials port.

6. The method of claim 5 wherein the step of deflecting the material comprises employing a plurality of inner ring deflectors.

7. The method of claim 1, wherein the step of introducing the material into the first chamber comprises introducing the material into the first chamber under gravity feed, and further comprising providing a second chamber which recieves a partially dried material into the second chamber using a common air stream/materials port.

8. The method of any of claims 1–7 wherein the fibrous material comprises a pulp.

9. The method of any of claims 1–7 wherein the fibrous material comprises a natural fiber.

10. The method of any of claims 1–4 wherein the step of providing a high velocity air stream comprises providing the air stream with a velocity of at least 300 feet per second.

11. The method of any of claims 1–4 wherein the step of providing a high velocity air stream comprises providing the air stream with a velocity of at least 500 feet per second.

12. The method of any of claims 1–4 wherein the step of providing a high velocity air stream comprises providing the air stream with a temperature of between about 50° F. and about 300° F.

13. The method of any of claims 1–4 wherein the step of providing a high velocity air stream comprises providing the air stream with a temperature of between about 60° F. and about 150° F.

14. The method of claim 13 wherein the step of causing the material to exit the first chamber comprises providing an average total transit time of the material in the first chamber of between about 2 and about 10 seconds, inclusive.

15. The method of any of claims 1–4 wherein the step of providing a high velocity air stream comprises providing the air stream with a temperature of between about 70° F. and about 120° F.

16. The method of any of claims 1–4 wherein the step of causing the material to exit the first chamber comprises providing an average total transit time of the material in the first chamber of between about 2 and about 10 seconds, inclusive.

17. The method of any of claims 1–4 wherein the step of causing the material to exit the first chamber comprises providing an average total transit time of the material in the first chamber of between about 3 and about 7 seconds, inclusive.

18. The method of any of claims 1–4 wherein the step of providing a high velocity air stream comprises providing the air stream with a velocity of at least 100 feet per second, wherein the step of providing a high velocity air stream comprises providing the air stream with a temperature of between about 60° F. and about 150° F., and wherein the step of causing the material to exit the first chamber comprises providing an average total transit time of the material in the first chamber of between about 2 and about 10 seconds, inclusive.

19. The method of any of claims 1–4 wherein the step of providing a high velocity air stream comprises providing the air stream with a velocity of at least 300 feet per second, wherein the step of providing a high velocity air stream comprises providing the air stream with a temperature of between about 60° F. and about 150° F., and wherein the step of causing the material to exit the first chamber comprises providing an average total transit time of the material in the first chamber of between about 2 and about 10 seconds, inclusive.

20. The method of any of claims 1–4 wherein the step of providing a high velocity air stream comprises providing the air stream with a velocity of at least 500 feet per second, wherein the step of providing a high velocity air stream comprises providing the air stream with a temperature of between about 60° F. and about 150° F., and wherein the step of causing the material to exit the first chamber comprises providing an average total transit time of the material in the first chamber of between about 2 and about 10 seconds, inclusive.

21. A method of producing a fluffy material from a damp fibrous material comprising subjecting the damp material to any of the methods of claims 1–7.

22. The method of claim 21 wherein the step of providing a high velocity air stream comprises providing the air stream with a velocity of at least 300 feet per second, and wherein the step of providing a high velocity air stream comprises providing the air stream with a temperature of between about 60° F. and about 150° F.

23. The method of claim 21 wherein the step of providing a high velocity air stream comprises providing the air stream with a velocity of at least 500 feet per second, and wherein the step of providing a high velocity air stream comprises providing the air stream with a temperature of between about 60° F. and about 150° F.

* * * * *